US008522433B2

(12) United States Patent
Kinder

(10) Patent No.: US 8,522,433 B2
(45) Date of Patent: Sep. 3, 2013

(54) METHOD OF INSTALLING A SEAL

(75) Inventor: Johnny Kinder, Cades, SC (US)

(73) Assignee: Freudenberg-NOK General Partnership, Plymouth, MI (US)

( * ) Notice: Subject to any disclaimer, the term of this patent is extended or adjusted under 35 U.S.C. 154(b) by 0 days.

(21) Appl. No.: 13/312,510

(22) Filed: Dec. 6, 2011

(65) Prior Publication Data

US 2012/0137495 A1 Jun. 7, 2012

Related U.S. Application Data

(60) Provisional application No. 61/420,417, filed on Dec. 7, 2010.

(51) Int. Cl.
*B21D 53/84* (2006.01)
*B23P 11/00* (2006.01)

(52) U.S. Cl.
USPC ..... 29/888.3; 29/450; 29/451; 29/407.1; 29/469; 29/402.2; 29/789; 29/811.2; 29/235; 277/309; 277/500

(58) Field of Classification Search
USPC ..... 29/450, 451, 407.1, 469, 888.3, 402.2, 29/787, 789, 811.2, 235, 270, 271, 272, 280, 29/282, 244, 255; 277/551, 313, 309, 434, 277/436, 596, 467, 500, 909, 357, 935; 123/197.1, 197.2
See application file for complete search history.

(56) References Cited

U.S. PATENT DOCUMENTS

| | | | | |
|---|---|---|---|---|
| 2,860,535 | A | 11/1958 | Fowler | |
| 3,030,702 | A | 4/1962 | Fowler | |
| 3,165,949 | A | 1/1965 | Thill | |
| 3,249,363 | A * | 5/1966 | Chatfield | 277/311 |
| 3,553,817 | A * | 1/1971 | Lallak | 29/235 |
| 4,091,521 | A * | 5/1978 | Dygert | 29/451 |
| 4,551,898 | A | 11/1985 | Provost | |
| 4,815,884 | A | 3/1989 | Halliday, Jr. et al. | |
| 5,052,695 | A | 10/1991 | Curtis | |
| 5,503,404 | A | 4/1996 | Newton et al. | |
| 6,370,751 | B1 * | 4/2002 | Rullmann et al. | 29/235 |
| 7,284,759 | B2 | 10/2007 | Heldmann et al. | |
| 7,651,102 | B2 | 1/2010 | Heldmann et al. | |
| 8,209,832 | B1 * | 7/2012 | Anderson et al. | 29/244 |

* cited by examiner

*Primary Examiner* — Sarang Afzali
(74) *Attorney, Agent, or Firm* — Daniel J. Sepanik, Esq.; Harness, Dickey & Pierce, P.L.C.

(57) ABSTRACT

A low cost and simple seal installation method provides for easy installation of bonded pistons and lip seals in an automatic transmission or other industrial machine. The installation method utilizes a flexible circular disc that can be inserted in a gap between the bore and the shaft and is pressed against the seal lip to flip the seal lip to its desired orientation while the disc is rolled around the circumference of the gap to orientate the entire seal in its proper position.

7 Claims, 2 Drawing Sheets

METHOD OF INSTALLING A SEAL

This application claims the benefit of U.S. Provisional Application No. 61/420,417, filed Dec. 7, 2010. The entire disclosure of the above application is incorporated herein by reference.

FIELD

The present disclosure relates to a low cost seal installation device and a simple and effective method of installing a seal.

BACKGROUND

This section provides background information related to the present disclosure which is not necessarily prior art.

Automotive transmissions, engines, vehicle drivetrains and other industrial machinery often utilize seals for maintaining lubricant in a defined space and/or for excluding dirt and debris from entering the machinery. The seals are often disposed in a narrow space between a bore and a shaft and can be difficult to assemble properly. High cost tools are often utilized for installing a seal in a transmission or other environment. The cost of these tools is justified in a manufacturing assembly process where the tool is used numerous times in a single shift and the reliable installation process must take place at a rapid pace. However, a low cost alternative is needed for use with transmission overhaul kits where the cost of a conventional installation tool can far exceed the cost of the seals being replaced.

SUMMARY

This section provides a general summary of the disclosure, and is not a comprehensive disclosure of its full scope or all of its features.

A low cost and simple installation tool is designed to ease the installation of bonded pistons and lip seals in an automatic transmission or other industrial machine. The installation tool is in the form of a flexible circular disc that can be a few inches in diameter and up to several inches depending upon the diameter of the seal being installed. The seal lip can be assembled within an interior wall of a bore or can be assembled to an outer wall of a shaft or piston received in the bore. If a shaft is used, the shaft can be a rotating or reciprocating shaft, or both. Once the shaft or piston is initially inserted into the bore, the seal lip can be flipped backward away from its intended orientation. The flexible circular disc, having a diameter smaller than a diameter of the gap between the bore and the shaft is then inserted into the gap and pressed against the seal lip to flip the seal lip to its desired orientation while the disc is rolled around the circumference of the gap to orientate the entire seal in its proper position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
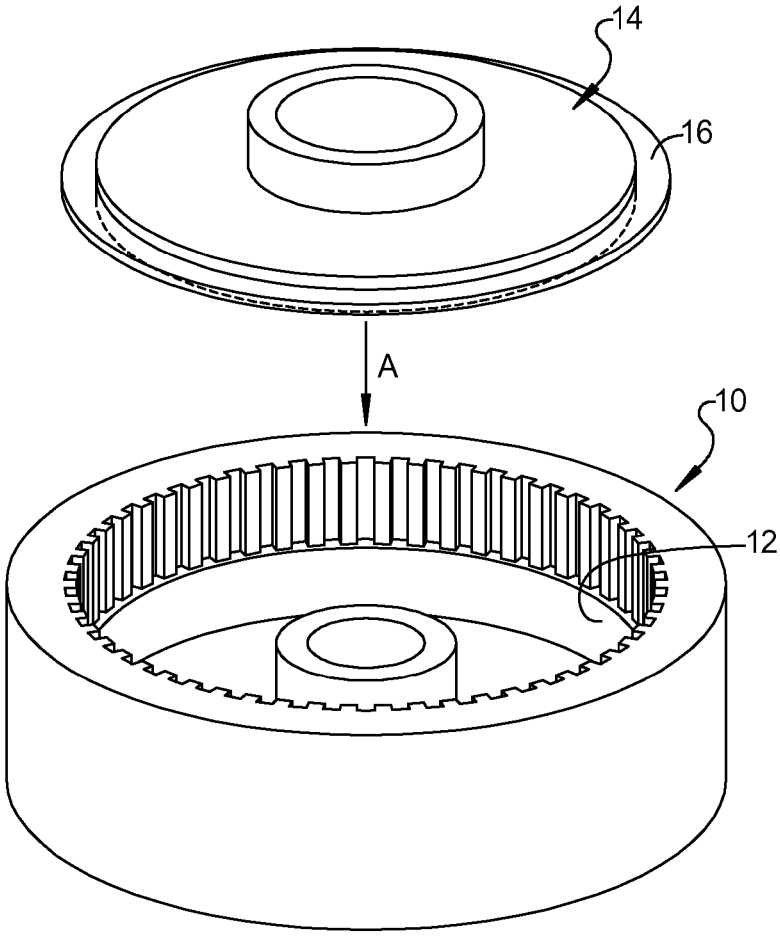
FIG. 1 is an exploded perspective view of a housing defining a bore and a shaft received in the bore with a seal lip assembled to the shaft according to an exemplary seal arrangement.
Figure 3:
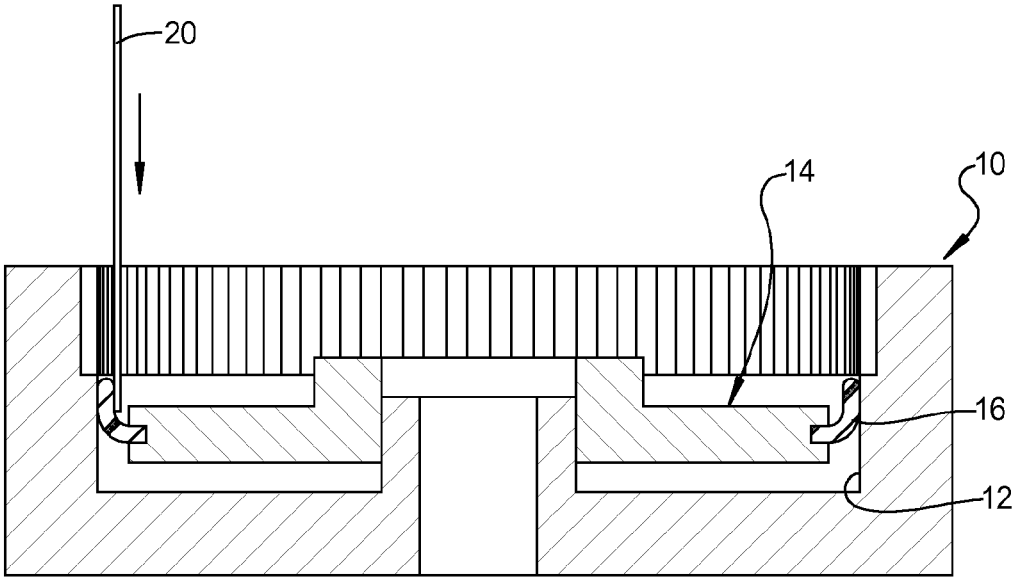
FIG. 3 is a cross-sectional view showing a seal lip flipped from its proper orientation during the assembly of a shaft within a bore and having the installation tool inserted therebetween to properly orient the seal lip.

With reference to FIG. 1, a housing 10 is provided that defines a bore 12 for receiving a shaft or piston 14 therein. The shaft or piston 14 can be provided with a lip seal 16 on an exterior surface thereof that is designed to engage the interior surface of the bore 12. Alternatively, it should be understood that the lip seal could be disposed on the interior surface of the bore 12 so as to engage an exterior surface of the shaft or piston 14. Furthermore, the shaft or piston can be a rotating shaft, or a reciprocating piston or rod as is known in the art. The seal lip 16 is generally received in a groove 18 provided in the exterior surface of the shaft 14 and is designed to engage the bore 12 extending axially in the direction of insertion of the shaft 14 as illustrated by arrow A in FIG. 1. Upon insertion of the shaft 14 into the bore 12, as illustrated in FIG. 3, the seal lip 16 can become inverted or flipped backward from its desired orientation due to frictional engagement of the seal lip 16 with the interior surface of the bore 12.

Figure 2:
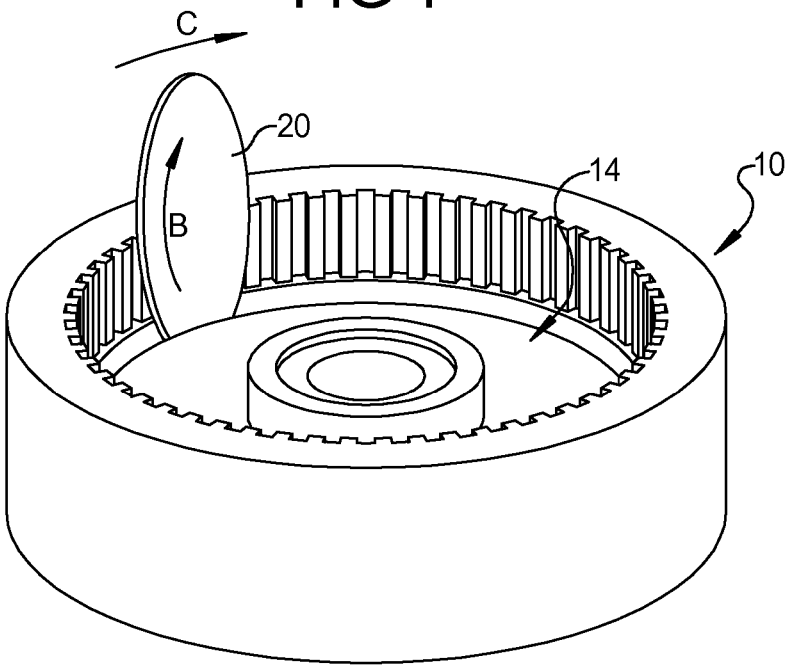
FIG. 2 is a perspective view illustrating the use of an installation tool according to the principles of the present disclosure to properly orient the seal lip between the shaft and the bore.
Figure 4:
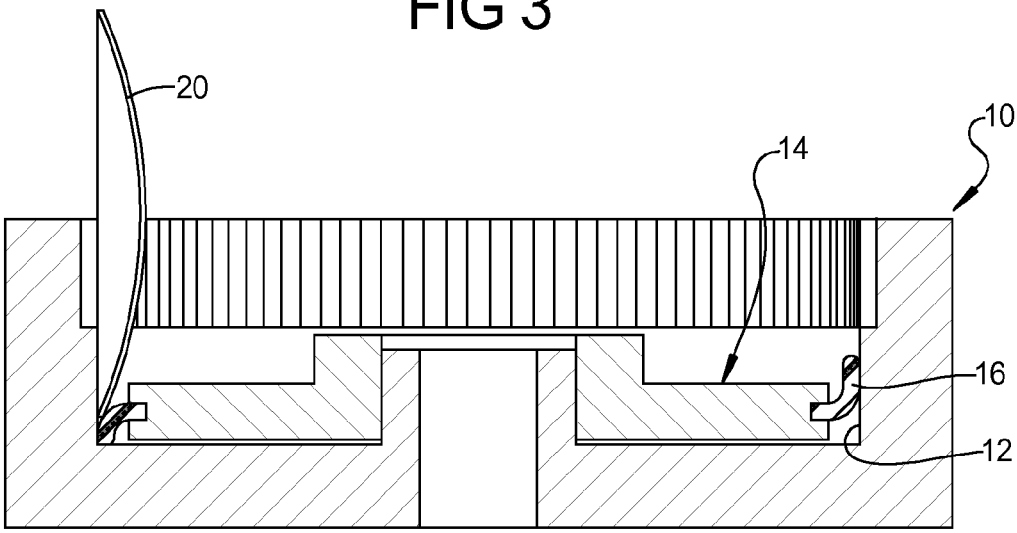
FIG. 4 is a cross-sectional view similar to FIG. 3, with the seal lip being partially correctly oriented by rotation of the installation tool around the circumference of the seal.
Figure 5:
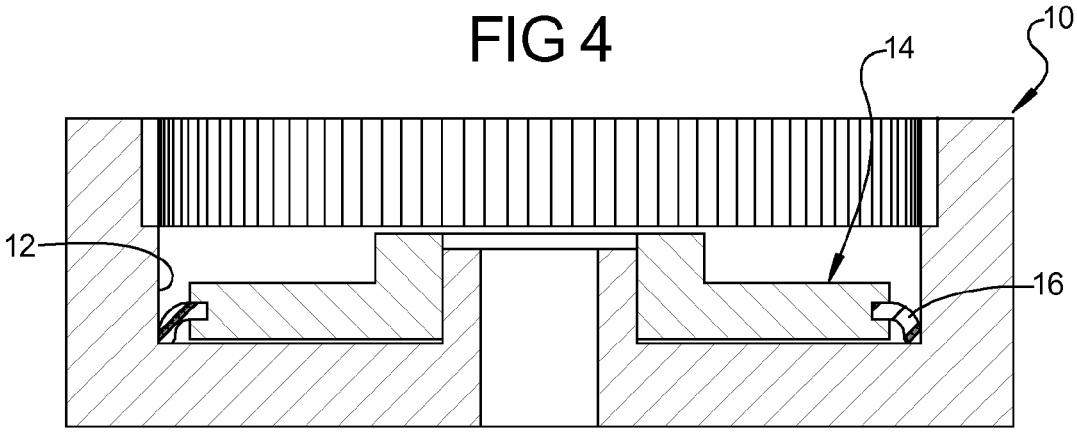
FIG. 5 is a cross-sectional view similar to FIG. 3 with the seal lip being correctly oriented after use of the installation tool according to the principles of the present disclosure.

As illustrated in FIG. 4, the installation tool 20 in the form of a circular thin flexible disc can be inserted in the gap between the shaft 14 and the bore 12, and a downward force is applied thereto to cause the seal lip 16 to flip back to its intended orientation. The circular disc 20 can then be rotated as illustrated by arrow B in FIG. 2 so that the rotation of the circular disc 20 is moved in the direction of arrow C around the circumference of the seal lip 16 so as to cause the seal lip to be pressed into its desired orientation, as shown in FIG. 5. It should be understood that during the assembly process, a lubricating oil can be applied to the interior surface of the bore 12 as well as to the lip seal 16 in order to facilitate the sliding of the lip seal 16 from its inverted orientation to its desired orientation.

The flexible circular disc 20 can be provided with an appropriate diameter so as to allow a user to manipulate the disc around the circumference of the seal 16. The circular disc 20 is preferably flexible to allow the disc to be curved generally as illustrated in FIG. 4, so as to match the curvature of the bore 12 as the disc 20 is rotated around the circumference of the seal lip 16. The disc 20 preferably has a thickness that is narrower than the gap disposed between the bore 12 and shaft 14 so as to easily allow the disc 20 to be inserted therebetween.

According to an embodiment of the present disclosure, the disc can have a diameter of approximately five inches, although the disc diameter can range from between two inches and up to eight inches, depending upon the size of the seal being installed. The flexible circular disc can be made of a high density polypropylene material while other plastic, elastomeric, polymeric, or other materials such as paper board could also be used. The flexible disc preferably does not have any sharp edges that can cause scratching of the lip seal during installation. The flexible disc, when used as an installation tool, is a very low cost device that ensures proper seal installation as it is flexibly rotated around the seal circumference.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of installing a seal, comprising the steps of:

installing an annular seal lip on one of a shaft and a bore;

inserting said shaft into said bore;

inserting an edge of a circular disc into a space between said shaft and said bore to contact said seal lip with said circular disc; and pressing said seal lip in an axial direction into a desired orientation with said circular disc while rolling the edge of said circular disc around a circumference of said seal lip.

2. The method according to claim 1, wherein said circular disc is made of flexible material.

3. The method according to claim 1, wherein said circular disc is made of a high density polypropylene material.

4. The method according to claim 1, wherein said circular disc has a thickness less than a gap distance between said shaft and said bore.

5. The method according to claim 1, wherein said shaft is a rotary shaft.

6. The method according to claim 1, wherein said shaft is a reciprocating piston.

7. The method according to claim 1, wherein said circular disc has a diameter of between two and eight inches.

* * * * *